United States Patent [19]

Savoie, Jr.

[11] 4,080,964

[45] Mar. 28, 1978

[54] DIVING GAS RECOVERY APPARATUS

[76] Inventor: Hilbert Joseph Savoie, Jr., P.O. Box 98, Boutte, La. 70039

[21] Appl. No.: 700,320

[22] Filed: Jun. 28, 1976

[51] Int. Cl.[2] ..... A62B 7/00

[52] U.S. Cl. ..... 128/142.3; 61/70 R; 137/251

[58] Field of Search ..... 128/142 R, 142 G, 142.2, 128/142.3, 142.7, 146.4, 146.5, 204; 137/251, 81, 252, 247.31; 61/70 R, 69 R, 69 A; 114/16 A, 16 D, 16 E

[56] References Cited

U.S. PATENT DOCUMENTS 3,968,795 7/1976 O'Neill et al. ..... 128/142.3

FOREIGN PATENT DOCUMENTS 399,574 11/1942 Italy ..... 128/142.3

*Primary Examiner*—Stephen C. Pellegrino
*Assistant Examiner*—Henry J. Recla
*Attorney, Agent, or Firm*—Lester L. Hewitt

[57] ABSTRACT

An improved diving habitat for providing breathing gas to a diver in which expired breathing gas is recovered from the habitat utilizing an indirect fluid coupling which is in fluid communication with the interior of the habitat and with a recovery line adapted for connection to a diving gas reconditioning system, the coupling providing for the transfer of the expired breathing gas from the habitat to the recovery line under normal conditions and further providing for a flow of water to the recovery line from the water environment in the event of a dangerous change in pressure in the recovery line.

18 Claims, 11 Drawing Figures

DIVING GAS RECOVERY APPARATUS

BACKGROUND OF THE INVENTION

The field of this invention is underwater diving, and in particular apparatus substantially contributing to the successful and safe recovery of expired diving gas.

In underwater diving situations, and in particular in deep sea diving situations, where the diver must be underwater for extended periods, it is known to provide a breathing gas at a pressure at least slightly greater than the hydrostatic pressure of the water environment in which the diver is operating. Normal air containing nitrogen cannot be used safely as a breathing gas because nitrogen tends to become absorbed in the blood and tissues of the diver. Absorbed nitrogen must be removed before the diver is exposed to ambient air pressures or the absorbed nitrogen will expand within the blood and tissues and possibly kill the diver. This phenomenon is generally known as nitrogen narcosis. Because nitrogen is unsafe, helium has been effectively substituted for nitrogen. Helium is extremely inert and is not absorbed by the body. However, helium is a rare gas and is therefore extremely expensive to produce in sufficient quantities to use during extended diving operations. Helium is used most often in a mixture with oxygen only. Sometimes a small percentage of nitrogen is included in the helium-oxygen mixture to enhance sound transfer. Another mixture sometimes used is a hydrogen-oxygen mixture. The disadvantage of a hydrogen-oxygen mixture is the explosiveness of hydrogen. So a helium-oxygen mixture, with perhaps some nitrogen, is the most desirable breathing gas presently used.

Until a few years ago, the helium-oxygen mixture breathed by a diver was continuously delivered to the diver's helmet and simply exhausted from the diver's helmet to the water environment. Simple exhaustion of the helium-oxygen mixture constitutes a total waste of the helium, which is certainly costly. A partial solution to this expensive waste of helium has been found in a diver carried scrubber that circulates expired breathing gas through a carbon dioxide scrubber and back into the helmet or other breathing habitat. Since no oxygen is added, the gas must be expelled to the water environment when the oxygen is spent.

In more recent years, there have been several patents issued disclosing reconditioning systems for receiving the expired breathing gas from the diver's helmet and effectively reconditioning the breathing gas for reuse. For example, U.S. Pat. No. 3,802,427 (and divisional Pat. Nos. 3,924,618; 3,924,616 and 3,924,619) disclose a method and apparatus for reconditioning the expired breathing gas of a diver. The reconditioning process disclosed in these patents, all owned by Taylor Diving & Salvage Co., Inc., includes a carbon dioxide scrubber, a water removal means and an oxygen additive device for making up for oxygen expended through the breathing process. After the expired breathing gas is reconditioned, it is then delivered again to the diver's helmet. The helmet disclosed in the Taylor Diving patents includes an incoming line for delivering breathable gas and a recovery line for returning expired breathing gas to the reconditioning system, which may be located on the surface or in a subsurface module. The incoming line includes a check valve and a throttle valve for controlling the flow of breathable gas into the helmet. The recovery line includes a safety shut-off valve and a back pressure regulator valve to control the pressure in the recovery line.

U.S. Pat. No. 3,831,594 of Charles R. Rein also discloses a system for reconditioning expired breathing gas and delivering the expired breathing gas back to the diver's mouth piece or habitat at operating depth. The basic steps of the Rein patent involved in reconditioning the expired breathing gas are similar to those of the Taylor Diving patents except that cryogenic means are used to refresh the oxygen supply. No particular helmet is disclosed in this patent. However, a schematic discloses the connection of a check valve to the incoming line to be connected to the habitat, which may, of course, be a diving helmet, and another check valve to be mounted in the recovery line which takes expired breathing gas away from the habitat. Another process for reconditioning spent breathing gas is disclosed in U.S. Pat. No. 3,941,124 of Rodewald, et al. Again, no particular helmet structure is disclosed in the Rodewald patent. U.S. Pat. No. 3,859,994 of Almqvist, et al. Also discloses a exhaled gas reconditioning system, without disclosing a particular helmet structure. The Almqvist patent does refer to the mounting of a pressure regulator in the helmet recovery line to evidently control the pressure therein. U.S. Pat. No. 3,481,333 of Garrison may also be of interest.

At this point, it is reasonable to conclude that there is probably more than one diving gas recovery system available which can effectively recondition the exhaled breathing gas of the diver by the suitable removal of carbon dioxide and water and addition of oxygen in order to continuously reuse that valuable commodity--helium. Concerning the helmets, several of the patents disclose the use of check valves and/or regulator valves in the incoming and outgoing lines from a diver's helmet or other habitat. However, none of these patents discussed refer to any particular problems with the helmet.

It is known that the breathing gas supplied to the helmet must be delivered at a pressure higher than the hydrostatic pressure of the depth at which the helmet is being used. Thus, the spent or expired breathing gas delivered to the recovery line connected to the helmet is also at a higher pressure than the hydrostatic pressure of the water environment at the depth of use of the helmet. But, this is only the normal situation. It has been discovered that the pressures in the recovery line may be dangerously unpredictable and can actually reach such low levels that a dangerous suction or negative pressure is created in the recovery line. This undesirable suction may be deadly to the diver, for it may draw out all the breathing air out of the diver's helmet. The mounting of check valves such as disclosed in U.S. Pat. Nos. 3,802,427 and 3,831,594 and pressure regulators such as disclosed in U.S. Pat. No. 3,859,994 in the recovery lines may be attempts to prevent a dangerous change in pressure from being applied to the interior of the helmet. Unfortunately, the use of such valves has not been successful in all situations. For valves have moving parts and moving parts are subject to failure under stress, which may result in the death of a diver.

SUMMARY OF THE INVENTION

It is an object of this invention to provide an extremely safe and reliable gas transfer method and apparatus for a diving habitat, which may be a helmet or mask, wherein the expired breathing gas from the diver's habitat is transferred to a recovery line adapted for connection to a gas reconditioning system without having to directly connect the recovery line to the diver's habitat or to an exhaust line leading therefrom.

It is further an object of this invention to provide method and apparatus for transferring expired breathing gas from a diver's habitat while preventing an application of a dangerous suction or negative pressure to the diver.

These objects and other objects of this invention are provided by a new and improved diver's habitat which includes means for safely transferring expired breathing gas from the diver to a diving gas reconditioning system. The diving habitat of this invention is adapted for connection to a source of breathable gas and for connection to a diving gas reconditioning system for receiving expired breathing gas from the diving habitat and reconditioning the gas for reuse.

The new and improved diving habitat of this invention includes a diving habitat body adapted for mounting with the head of the diver and for receiving a breathable gas from a supply line. Coupling means are provided in fluid communication with the interior of the habitat body and with a recovery line adapted for connection to a diving gas reconditioning system. The coupling means includes means for transferring expired breathing gas from the habitat body to the recovery line under normal conditions and further includes safety means for preventing a deleterious change in pressure in the habitat body in spite of a dangerous change in pressure in the recovery line. The coupling means includes a collection chamber mounted with the habitat body. The collection chamber is in fluid communication with the interior of the habitat body in order to receive therefrom the expired breathing gas. The chamber is also in fluid communication with a recovery line extending to a diving gas reconditioning system and finally, the collection chamber is in fluid communication with the water environment of the diver and habitat body. Under normal conditions, the chamber receives and provides a collection zone of expired breathing gas, which gas is transferred from the zone to the recovery line and thus to a diving gas reconditioning system. However, should the pressure level within the recovery line reach a dangerous level such as a negative pressure or suction, the water environment will immediately begin flow directly into the recovery line thus substantially cutting off flow from the interior of the habitat body to the recovery line, which neutralizes the deleterious effect of the suction pressure in the recovery line and prevents a suction pressure from being applied to the interior of the habitat. These features and other features of this invention will be described in more detail hereinafter. It should be understood that the actual scope of the patent protection sought will be set forth exclusively in the claims and that the summary of the invention and the detailed description of the preferred embodiment are not intended to limit the scope of the appending claims. As used herein, the term "habitat" refers to a diving helmet or mask or other breathing unit that supplies a breathing gas to the diver.

DESCRIPTION OF THE PREFERRED EMBODIMENT

Figure 1:
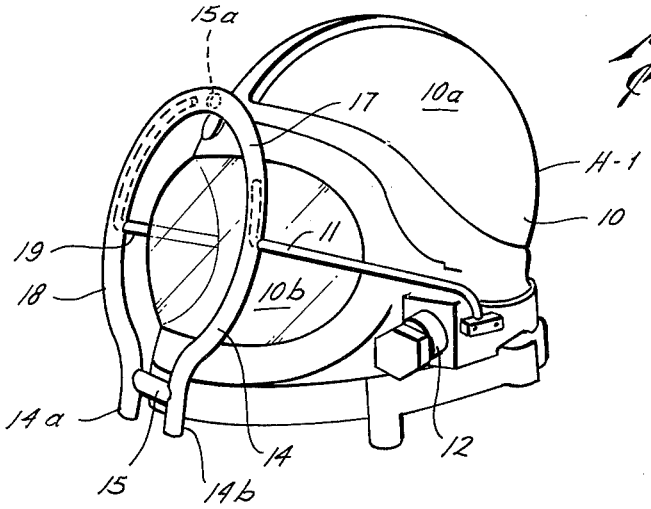
FIG. 1 is an isometric view of the new and improved diving habitat of this invention which includes a coupling means for safely transferring expired breathing gas to a diving gas recovery line.
Figure 2:
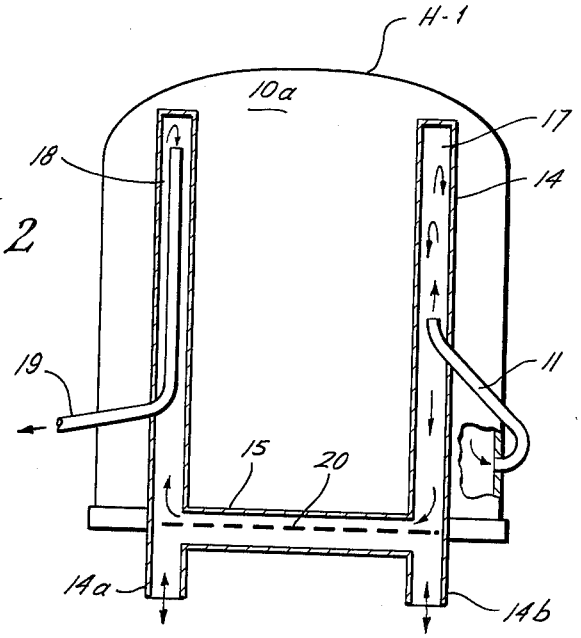
FIG. 2 is a front, schematic view of the diving habitat invention of FIG. 1 in order to better illustrate the operation of the coupling means of this invention.

Referring to the drawings, and in particular FIGS. 1 and 2, a new and improved diving habitat H-1 is illustrated for safely and effectively transferring exhaled or expired breathing gas from the diving habitat to a diving gas reconditioning system such as described previously. The term habitat is meant to include a diving mask, helmet or other breathing device. For the purpose of describing a particular embodiment, H-1 refers in particular to a full diving helmet adapted for mounting on the head of the diver. This invention is directed to a helmet H-1 that safely and effectively transfers expired breathing gas to such a diving gas reconditioning system. The helmet H-1 includes a helmet body 10. The helmet body 10 is basically identical to known helmet bodies and includes a global body portion 10a, a clear, sealed viewing section 10b and a sealing flap (not shown) mounted on the underside to effectively seal off the diver's head from the water environment. The diving helmet body 10 further includes an inlet mounted at the rear thereof (not shown) for receiving fresh or reconditioned breathing gas from a system such as the diving gas reconditioning systems previously described. Such a helmet is described in U.S. Pat. No. 3,353,534. It has been previously mentioned that H-1 may be a helmet, a mask or other breathing apparatus. If H-1 is a mask, then the body therefor refers to the mask portion and/or structure for supporting the mask on the face of a diver.

The diving helmet H-1 includes an exhaust line or tube 11 which is mounted onto the body 10 and is in fluid communication with the interior of the helmet. A valve 12 is mounted between the exhaust line 11 and the interior of the helmet in order to manually control flow from the interior of the helmet body 10 to the exhaust line 11. The exhaust line 11 is connected to an approximately circular tubular member 14. The tubular member 14 terminates in bottom straight portions 14*a* and 14*b* which are interconnected by a transfer tubular member 15. A barrier 152 at the top of the tubular member 14 divides the tubular member 14 into a first chamber 17 and a second chamber 18. A recovery line portion 19 is mounted in the tubular portion housing the second chamber 18. The recovery line portion 19 is connected by suitable means with a recovery line which extends from the helmet H-1 to a diving gas reconditioning system. The diving gas reconditioning system may be mounted on the surface of the water or in a subsurface module, both embodiments having been disclosed in the previously discussed patents.

FIG. 2 is a schematic view of the helmet H-1 of FIG. 1. For the purposes of clarity, like numbers and letters will be used to describe the same parts so that the relationship between FIGS. 1 and 2 is clear. The only difference between FIGS. 1 and 2 is that the tubular member 14 is not illustrated as being circular, but is rather illustrated as being two separate tubular sections which are closed at the top thereof, thus eliminating the need for the barrier 15*a*.

The operation of the helmet H-1 of this invention will now be described with respect to both FIGS. 1 and 2.

Breathing gas is supplied from a suitable source such as one of the diving gas reconditioning systems mentioned. The pressure of the breathing gas as delivered to the helmet is at least slightly greater than the hydrostatic pressure level of the water environment at the depth surrounding the diver and helmet H-1. For example, and not by way of limitation, the pressure of the breathing gas delivered to the helmet H-1 may be equal to the sum of the hydrostatic pressure at the helmet depth and atmospheric pressure or ambient pressure. As the breathing gas is exhaled, the breathing gas flows to exhaust line 11. While the pressure in exhaust line 11 is slightly less than the pressure in the incoming breathing gas line, it is still above the hydrostatic pressure of the water environment. The expired breathing gas flowing into line 11 flows into the first chamber 17. Since the pressure of the expired breathing gas within the chamber 17 is greater than the hydrostatic pressure level of the water environment, a zone is created within the chamber 17, within transfer passage 15, and within the second collection chamber 18, which contains only expired breathing gas. This zone is referred to by the letter Z and is defined by the structure of the tubular member 14 and by the expired breathing gas and water interface 20. Under normal operating conditions, the pressure in recovery line 19 will be slightly less than the pressure within the expired breathing gas zone Z, as defined within chambers 17, 18 and transfer tube 15, thus causing flow of the expired breathing gas from the zone Z into the recovery line 19. The expired breathing gas is collected and delivered to the recovery line 19, which is adapted for attachment to a diving gas reconditioning system. Therefore, the helium is continuously reclaimed for reuse.

One of the dangers which has been observed in diving gas reconditioning apparatus is the inability to control the suction within the recovery line 19. The helmet H-1 includes a coupling means composed of circular tube 14 and transfer passage 15 for preventing a negative pressure in the recovery line 19 from acting on the interior of the helmet. Should the suction in recovery line 19 reach a dangerous level, the following phenomenon will occur. Immediately upon the pressure within the recovery line 19 being reduced to a dangerous level, the pressure within the zone Z will also be reduced as some of the expired breathing gas in zone Z rushes into the recovery line 19. This reduction in pressure will cause the interface 20 to be moved upwardly and fill the transfer passage 15 and the second chamber 18 so that water will flow into the recovery line 19. This flow of water into the recovery line 19 will continue so long as the pressure within the recovery line 19 is dangerously low. Flow of water into the recovery line 19 effectively blocks off and prevents flow of the expired gas in collection chamber 17 into the recovery line 19. Thus, the integrity of the pressure level within the chamber 17 is retained because no suction is applied thereto. The expired gas within the chamber 17 simply bubbles out into the water environment during this period. The helium is lost, but the life of the diver is saved because no dangerous suction is applied to the interior of the helmet body 10. Although the expired breathing gas and water interface is described as being within the transfer passage 15, it is possible that the interface 20 may be located below the transfer passage 15 and even above the transfer passage 15 within the chambers 17 and 18, although it is likely that at least some of the expired breathing gas will be lost out of end portion 14*b* in the latter situation.

Another embodiment H-2 of the diving helmet of this invention is illustrated in FIS. 3–6. Wherever possible, the same numbers and letters will be used to describe elements for the helmet H-2 as were used to describe the helmet H-1. The helmet body 10 includes one or more exhaust lines 11 which are valved at 12. A tubular ring 25 is mounted on the front of the helmet body 10 and is welded or otherwise connected to the exhaust line 11 so that expired breathing gas flows into the tubular ring 25. The tubular ring 25 is connected at the top end thereof to recovery tube 26. A flow control valve 27 of a suitable variety is mounted at the connection between the tubular ring 25 and the exhaust tube 26. The recover tube 26 is connected through swivel 26*a* to a recovery line which extends to a diving gas recovery system. The tubular ring 25 includes a downwardly extending end portion 25*a* attached to a tilt adjustment mechanism 30. Before describing the structure and operation of the tilt adjustment mechanism 30, the operation of the coupling means 31, which is comprised of exhuast line 11, tubular ring 25 and recovery tube 26, will first be described. For the purposes of this description, we will initially assume that the end 25*a* is open to the water environment and not connected to the tilt adjustment mechanism 30.

The operation of the coupling means 31 of the helmet H-2 is as follows for the helmet H-2 being in the upright position illustrated in FIG. 3. The exhaust line 11 carries expired breathing gas at a pressure at least slightly greater than the hydrostatic pressure of the water environment into tubular ring 25. The tubular ring 25 may have a barrier 25*b* just to the right of the recovery tube 26 as illustrated in FIG. 4. The barrier 25*b* acts to divide the tubular member 25 into a first collection chamber portion 32*a* and a second chamber portion 32*b*. The barrier 25*b* also serves to separate and prevent the direct transfer of expired breathing gas from exhaust line 11 to recovery tube 26. The pressure of the expired breathing gas in tubular ring 25 is sufficient to create an expired breathing gas and water interface somewhere within the downwardly extending tube portion 25*a*. Under normal conditions, the presence of the interface within the downwardly extending tubular portion 25*a* allows the transfer of expired breathing gas around the tube in a clockwise flow pattern and outwardly of the recovery tube 26. The pressure within the recovery tube 26 may be controlled at least in part by the control valve 27. Should the pressure within the recovery tube 26 reach an undesirably low level, the water from the environment will flow into second chamber portion 32*b* and into the recovery tube 27 thus blocking off further flow of expired recovery gas. The expired recovery gas will then be confined within chamber 25*b*, with at least part of the gas bubbling outwardly of the tube portion 25*a* and another part passing through the water in second chamber portion 32*b* to recovery tube 26. The flow and presence of water through second chamber portion 32*b* into the recovery tube 26 will prevent a loss of pressure within the first chamber portion 32*a* and thus prevent a loss of pressure within the helmet body 10. In this manner, as previously described with respect to the helmet H-1, the positive pressure integrity present within the helmet body 10 will be maintained.

The coupling means 31 of the helmet H-2 operates in substantially the same manner when the tubular ring barrier 25 is removed. With the tubular ring 25 being a single entire circular chamber comprised of chamber halves 32*a* and 32*b*, the expired breathing gas is transferred along the shortest path from the exhaust line 11 to the recovery tube 26. However, should the pressure in the tube 26 drop to an undesirable level, water from tube portion 25*a* will enter the chamber portions 32*a* and 32*b* and flow into the recovery tube 26 practically immediately filling the recovery tube with water. Filling of the recovery tube with water will prevent substantial transfer of expired breathing gas into the recovery tube 26 and thereby allow the pressure of the expired breathing gas in line 11 to be substantially unchanged. The expired gas then simply bubbles out of the tubular portion 25*a* and/or into recovery tube 26 with no deleterious suction pressure applied to the exhaust line 11.

Figure 3:
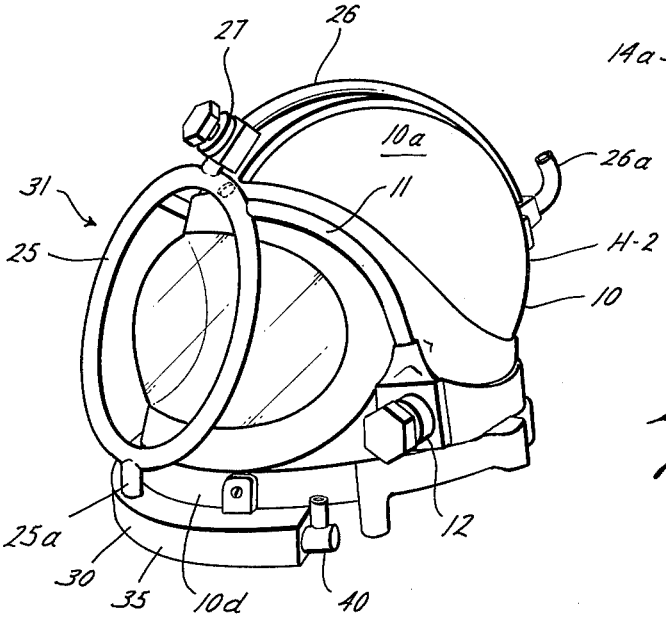
FIG. 3 is an isometric view of another embodiment of the diving habitat of this invention illustrating a coupling means and a tilt adjustment mechanism for operating the coupling means even when the diving habitat is in a tilted position.
Figure 4:
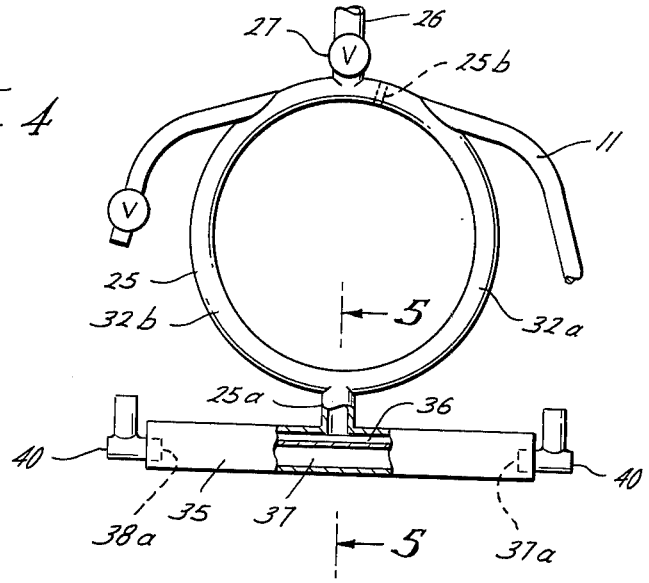
FIG. 4 is a front view of the coupling means and tilt adjustment mechanism of FIG. 3.
Figure 5:
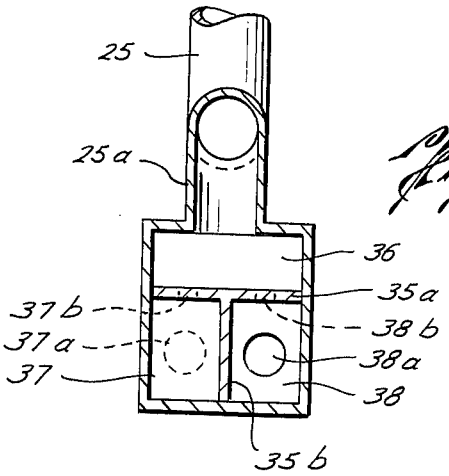
FIG. 5 is a sectional view of the tilt adjustment mechanism.
Figure 6:
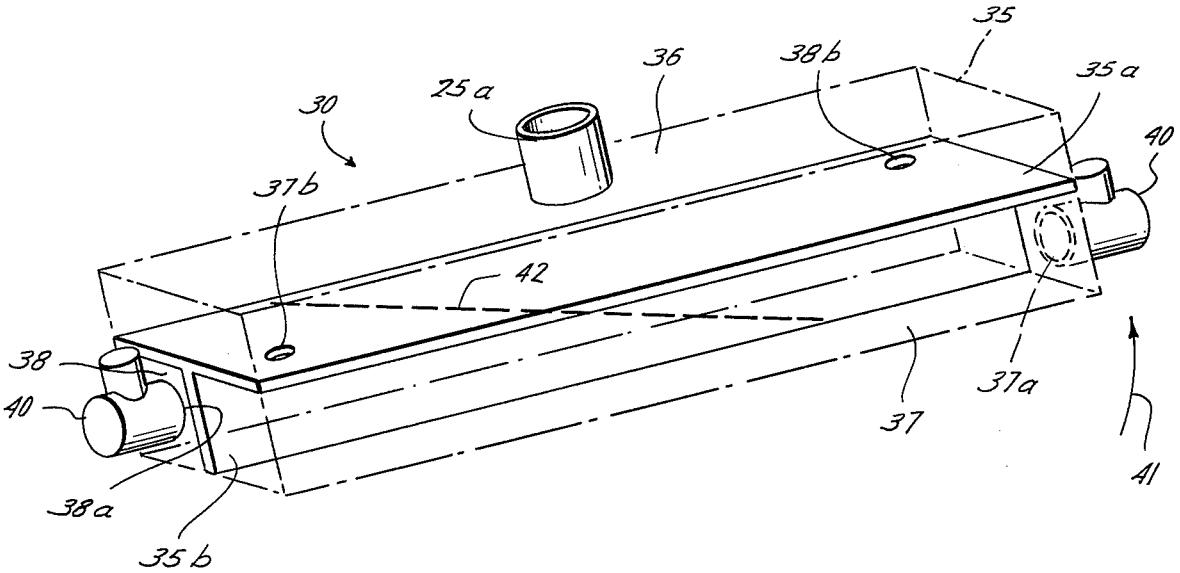
FIG. 6 is a partly sectional and partly schematic view of the tilt adjustment mechanism illustrating the cooperation between the various chambers thereof.

The tilt adjustment mechanism 30 is attached to the downwardly extending tubular portion 25*a* in order to prevent a loss of expired breathing gas when the helmet H-2 is tilted from the upright position illustrated in FIGS. 3 and 4. The tilt adjustment mechanism 30 includes a curved housing 35 which conforms in curvature to the front collar portion 10*d* of the helmet body 10. The housing 35 is basically rectangular when viewed from the front as in FIG. 4 and is basically square in cross section when viewed in the cross section of FIG. 5. Referring to FIGS. 4–6 (wherein a partly schematic view of the housing 35 is illustrated), the housing 35 is divided into three chambers. The first or upper chamber 36 is formed by a longitudinally extending wall member or partition 35*a* which is parallel to the top and bottom walls of the housing 35 as viewed in FIG. 5. A second chamber 37 and a third chamber 38 is formed by the wall member or partition 35*b* which extends from the bottom wall of the housing 35 into attachment with the wall or partition 35*a*. The second chamber 37 has an opening 37*a* at one end of the housing 35. The opening 37*a* has mounted therein an adapter 40. The purpose of the adapter 40 is simply to protect the second chamber 37 from the entry of foreign matter from the water environment. The second chamber 37 has an opening 37*b* at the other end of the housing 35 in the wall member 35*a* in order to provide fluid communication between the first chamber 36 and the second chamber 37.

The third chamber 38 has an opening 38*a* to the water environment at the other end of the housing 35 where second chamber opening 37*b* to the first chamber 36 is located. An adapter 40 is mounted in the opening. The third chamber 38 further has an opening 38*b* in wall member 35*a* on the same end as the opening 37*a* for second chamber 37. The opening 38*b* provides fluid communication between the third chamber 38 and the first chamber 36 and the opening 38*a* provides fluid communication between the third chamber 38 and the water environment.

One of the purposes of the tilt adjustment mechanism 30 is to prevent the escape of expired breathing gas when the helmet H-2 is tilted. For the purposes of explanation, the tilt adjustment mechanism 30 and in particular the housing 35 is illustrated partly in section and partly in schematic in FIG. 6. In FIG. 6, the tilt adjustment mechanism 30 and the helmet H-2 has been tilted in the direction of arrow 41, a counterclockwise direction thereby putting the housing 35 at an inclined angle with respect to horizontal. Line 42 represents the expired breathing gas and water interface level which is present with the housing 35 in the tilted position. It should be understood that this interface level is the same as the level in the end 25*a* when the helmet H-2 is in the upright position of FIGS. 3 and 4. We are assuming that the tilting has occurred without changing the depth of the helmet H-2 so that the hydrostatic water pressure is the same.

With the housing 35 in a tilted position, opening 37*a* in the second chamber 37 acts to allow entry of water into the chamber 37*a* and through opening 37*b* into the first chamber 36 to the level 42. This level 42 represents an application of the same hydrostatic pressure on the gas trapped in the first chamber 36 above the interface line 2 as was applied to the expired breathing gas when the helmet H-2 is in a horizontal position. In this manner, the pressure applied to the upper chamber 36 and thus to the expired breathing gas in the tubular ring 25 is the same as was applied with the helmet H-2 in an upright position. This prevents the expired breathing gas from flowing outwardly into the water environment rather than through the recovery tube 26 under normal conditions. The water environment is also available in the first chamber 36 so as to fill the tube 25 and recovery tube 26 should the pressure in the tube 26 reach an undesirably low level. The third chamber 38 acts in the same way as the second chamber 37 just described when the housing is tilted clockwise.

In the counterclockwise position of FIG. 6, the chamber 38 also acts to duplicate the purpose of the chamber 37. Referring to FIG. 6, the chamber 38 is exposed at opening 38*a* to the hydrostatic pressure of the water environment. The water through opening 38*a* acts along interface line 42 against the expired breathing gas in the upper part of the chamber 38 and in the upper chamber 36 in order to trap the expired breathing gas so that the gas will normally flow out of the recovery tube 26.

Therefore, both the lower chambers 37 and 38 act to trap gas whether tilted in a clockwise or a counterclockwise direction. In this manner, one of the chambers acts to duplicate the purpose of the other and make the device more reliable.

Without the tilt adjustment mechanism 30, it is possible that the relative depth of the recovery tube 26 would become lower than the depth of the end portion 25*a* thereby possibly making the pressure at the recovery tube 26 greater than the pressure at the opening in tube portion 25*a*. A tilting of the helmet H-2 to a position where the pressure in tube portion 25*a* is less than the pressure in the recovery tube 26 will tend to allow at least some of the gas to bubble outwardly and thus be wasted during tilting unless the tilt adjustment mechanism 30 is utilized. The various pressure relationships just described are presently though to be the explanation of the successful operation of the tilt adjustment mechanism. Even if the explanation is not quite correct, the person of ordinary skill in the art is certainly taught sufficiently to make and use the apparatus.

Figure 7:
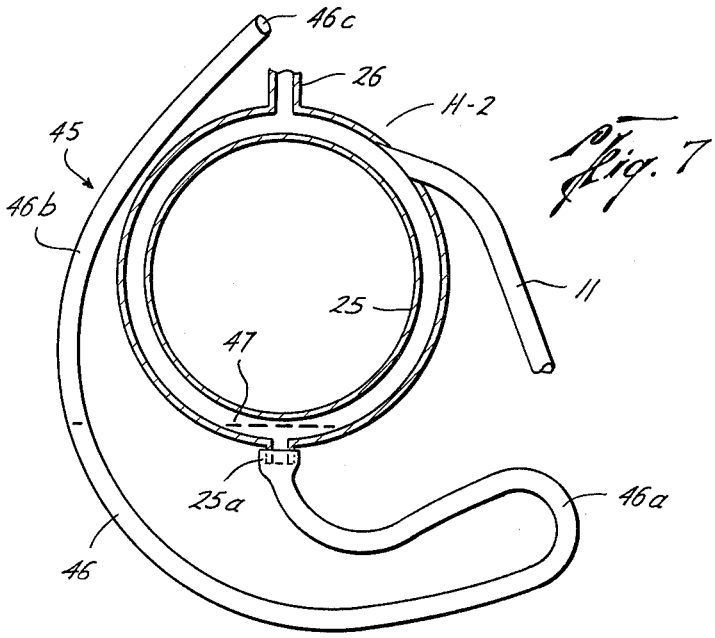
FIG. 7 is a front view of another embodiment of the tilt adjustment mechanism and coupling means of this invention.
Figure 8:
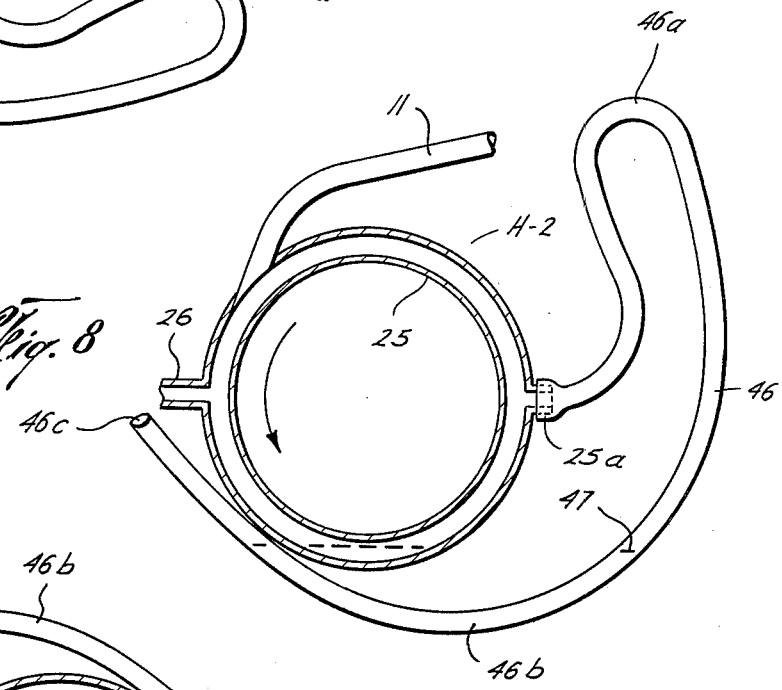
FIG. 8 is a front view illustrating the coupling means and tilt adjustment mechanism of FIG. 7 rotated 90° counterclockwise to the position illustrated in FIG. 7.
Figure 9:
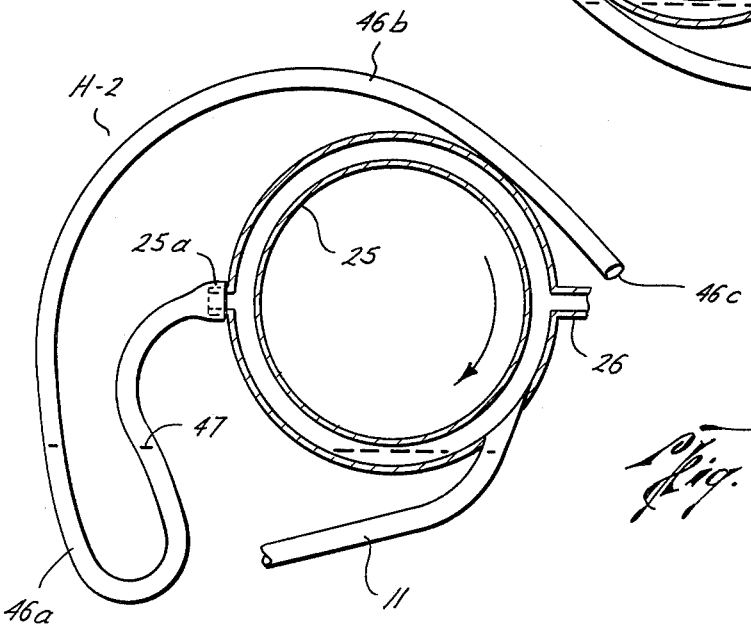
FIG. 9 is a front view of the coupling means and tilt adjustment mechanism of FIG. 7 rotated 90° clockwise compared to the position of FIG. 7.

Referring to FIGS. 7–9, another embodiment 45 for the tilt adjustment mechanism for helmet H-2 is illustrated. Again, exhaust line 11 is attached to a tubular ring 25 which has a bottom end portion 25*a*, when the helmet is in an upright position, which is normally exposed to a water environment. The tubular ring 25 terminates at its uppermost end in recovery tube 26, which may have valve 27 mounted therein. In FIG. 7, the helmet H-2 is illustrated in an upright position wherein the expired breathing gas and water interface is located in the bottom tubular portion 25*a* or in a lower portion of the tubular ring 25. In this condition, the expired breathing gas flows directly to the recovery tube 26. The tilt adjustment mechanism 45 is a tube 46 which is sealably connected to the bottom tubular end portion 25*a* and extends in a winding manner first to one side and then to the other side of the tubular ring 25 and then to a position terminating in an opening above the recovery tube 26. FIGS. 8 and 9 illustrate the operation of the tilt control tube 46 in tilted positions.

In FIG. 8, the helmet H-2 has been rotated 90° in a clockwise manner such that the opening into discharge tube 26 is at the same level as the opening for the tube portion 25*a*. Without the tilt control tube 46, the pressure at the opening for tube portion 25*a* would be equal to the pressure in the recovery tube 26, assuming no suction forces are further reducing the pressure at 26. It should be noted that if the tubular ring 25 is rotated further counterclockwise, the recovery tube 26 would actually be at a greater depth than the opening in tube portion 25*a*, which means that the pressure at the point of connection of tubular portion 26 to ring 25 would be greater than the pressure acting against the opening in tube portion 25*a*. Under these circumstances, it is more likely that the expired breathing gas would flow outwardly of the tube portion 25*a* and be forever lost in the water environment. The purpose of the tilt control tube 46 is to prevent such a loss.

The tilt control tube 46 operates in the following manner with the helmet H-2 rotating 90° counterclockwise to the position illustrated in FIG. 8. Since the helmet H-2 in this description is rotated and not changed in height, the level of the expired breathing gas and water interface does not change. This interface is defined by line 47. The tilt control tube 46 includes a first portion 46*a* which is wider or extends outside of the outer diameter of the tubular ring 25 on the right side as viewed in FIG. 7. The tilt control tube 46 further includes a second portion 46*b* which extends outside of the opposite or left side of the tubular ring 25 and terminates in an end portion 46*c* which is above the recovery tube 26. Referring to FIG. 8, the tube portion 46*a* is positioned above the top portion of the tubular ring 25 and portion 46*b* is positioned below the bottom portion of the tubular ring 25. Thus, water entering opening 46*c* is capable of exerting a hydrostatic pressure at the interface 47 at least equivalent, and perhaps slightly greater, than the prior hydrostatic pressure because a portion of the tilt control tube 46 is positioned at the same depth or lower than the opening in tube 25*a* in the upright position of FIG. 7. Thus the water in tilt control tube portion 46 acts to exert a hydrostatic pressure which holds or traps the expired breathing gas within the upper portion 46*a* of the tube and thus encourages the expired breathing gas to go outwardly of the recovery tube 26 in spite of the tilt.

In FIG. 9, the helmet H-2 is illustrated in a position rotated 90° clockwise with respect to the position of FIG. 7. In this position, the curved portion 46*a* of the tilt control tube 46 extends below the depth at which the tube portion 25*a* is located at in FIG. 7, which allows the application of hydrostatic pressure at a level equal to or greater than the hydrostatic pressure applied to the tube portion 25*a* in FIG. 7. The water at a pressure at least equal to the hydrostatic pressure applied to the tube portion 25*a* in FIG. 7. acts to confine the breathing gas within the tubular ring 25*a* so that the breathing gas is directed outwardly of the recovery tube 26. Should the helmet H-2 be rotated 180° with respect to FIG. 7, the end portion 46*c* of the recovery tube will still be below the original depth of the interface 47 thus allowing for the application of at least the same amount of hydrostatic pressure as to the device in FIG. 7. Without the tilt control tube 46, there would be a possibility that the pressure at the opening to tube portion 25*a* would be sufficiently less, due to the raise in height, to allow for at least some of the gas to pass outwardly into the water environment. Tilt control mechanism 45 acts in much the same way as the tilt adjustment mechanism 30 to prevent an undesired loss of the valuable expired breathing gas.

Figure 10:
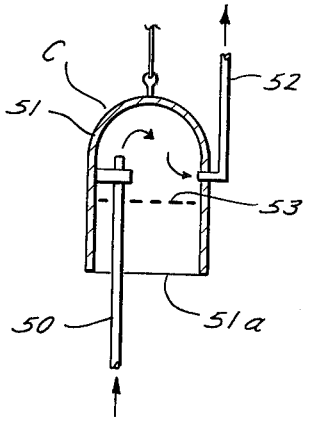
FIG. 10 is a side view partly in section and partly schematic of the indirect coupling of another embodiment of this invention for transferring fluid from one line to another without direct connection.

An indirect coupling C of another embodiment of this invention is illustrated in FIG. 10. The indirect coupling C may actually form part of the recovery line 19 for the helmet H-1 or for the recovery line connected to the recovery tube 26 for the helmet H-2 in order to neutralize at least some of the magnitude of suction which might be created in such a recovery line. However, since the indirect coupling C of FIG. 10 has applications beyond that of the neutralization of suction in recovery line 19, it will be described in broader terms. The coupling C includes a first flowline 50 which enters a chamber 51. The chamber 51 is open at 51*a* to an outside fluid environment. A second flowline 52 is also mounted in the chamber 51; however, there is not direct connection between the flowlines 50 and 51. In order for the indirect coupling C to effectively operate, the context in which the coupling C is utilized most effectively is for the transfer of a first fluid from the flowline 50 to the flowline 52 wherein the first fluid is normally carried through the flowline 50 at a pressure greater than the fluid outside of the chamber 51. In this manner, the first fluid flowing out of flowline 50 into the coupling C forms a fluid-to-fluid interface 53 with outside fluid and allows the first fluid to flow into the second flowline 52. However, should the pressure within flowline 52 be reduced sufficiently, the second fluid will fill the chamber 51 and enter the flowline 52, thus substantially shutting off the flowline 52 from the first fluid passing outwardly of the flowline 50. In this manner, the end portion of the flowline 50 is subjected to no less than the pressure of the second fluid entering the chamber 51 through opening 51*a* and therefore will not decrease in pressure to the decreased pressure level in flowline 52. The outside fluid is of a greater density such as being a liquid, as compared to the first fluid, such as a gas so that flow of the liquid into flowline 52 will prevent further flow of the gas.

Figure 11:
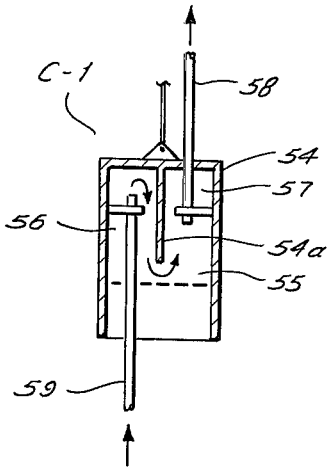
FIG. 11 is another partly sectional and partly schematic view of the indirect coupling device of FIG. 10.

The indirect coupling C-1 of FIG. 11 illustrates another embodiment for an indirect fluid coupling. In this embodiment, a chamber 54 which is basically rectangular as illustrated in the sectional drawing of FIG. 11 is provided with a partition 54*a* to divide the chamber 54 into first and second chambers 55 and 56, respectively. Again, the coupling C-1 may be utilized to connect parts of the recovery line 19 in order to prevent some of the deleterious effects caused by the total pressure drop between the helmet H-1 and the surface where the expired breathing gas is actually recovered. This is accomplished by neutralizing the suction at vertical points by placing indirect couplings C or C-1 at such points along the recovery line. Referring now to the indirect coupling C-1, an incoming flowline 59 includes an end portion positioned in a first chamber 57. The pressure of the incoming fluid 59 is such as to create an interface within the chamber 54 between the incoming fluid and the second fluid located outside of the chamber 54. Outgoing flowline 58 is mounted in the second chamber 56 and ordinarily receives the first fluid which passes from the first chamber 54 into the second chamber 56. However, should the pressure within the line 58 decrease substantially, the second or outside fluid will flow into the line 58 thus shutting off and preventing any exposure of the line 59 to such a deleterious pressure. Thus the couplings C and C-1 act to prevent a loss of pressure in the incoming flowlines 50 and 59. Should indirect couplings such as C and C-1 be mounted in the recovery line 19 for the helmets H-1 or H-2 at various points, the indirect couplings C and C-1 will serve to neutralize any suction in the line 19 at such points thus preventing such suction from being applied, at least in full magnitude, at the helmet H-1 or H-2.

The foregoing disclosure and description of the invention are illustrative and explanatory thereof, and various changes in the size, shape and materials as well as in the details of the illustrated construction may be made without departing from the spirit of the invention.

I claim:

1. A diving habitat for use underwater and being adapted for connection to a source of breathable gas and for connection to a diving gas reconditioning system for receiving expired breathing gas from the habitat and reconditioning said expired breathing gas for reuse, comprising:

a diving habitat body adapted for mounting with the diver and including means for receiving a breathable gas and a recovery line extending to the diving gas reconditioning system;

coupling means communicating the interior of said habitat body with said recovery line adapted for connection to such diving gas reconditioning system;

said coupling means including means transferring expired breathing gas from said habitat body to said recovery line under normal conditions; and said coupling means further including substitution means for transferring surrounding water into said recovery line in response to a dangerous change in pressure therein thereby regulating the transfer of expired breathing gas from said habitat body and preventing such deleterious change in pressure from acting on said diving habitat body.

2. The structure set forth in claim 1, including:

said substitution means includes means for interposing water at hydrostatic pressure between the interior of said habitat body and said recovery line to prevent the transfer of expired breathing gas to said recovery line.

3. The structure set forth in claim 1, wherein said coupling means includes:

a collection chamber mounted on said habitat body, said collection chamber including first, second and third openings to place said collection chamber in fluid communication with the interior of said habitat body, with said recovery line and with water at hydrostatic pressure, respectively, said water flowing into said recovery line in order to substantially block off the flow of expired breathing gas to said recovery line in response to a dangerous decrease in pressure in said recovery line.

4. The structure set forth in claim 1, wherein said coupling means includes:

an enclosed collection chamber mounted with said habitat body, said collection chamber having a first opening to mount an exhaust line from said habitat body such that expired breathing gas flows into said collection chamber;

said collection chamber including a second opening in fluid communication with the water environment;

said collection chamber including a third opening in fluid communication with said recovery line;

said water environment being at a hydrostatic pressure level; and said expired breathing gas being at a pressure greater than hydrostatic pressure, said opening to said water environment allowing said water to enter said chamber and said recovery line in response to said pressure in said recovery line dropping below hydrostatic pressure.

5. The structure set forth in claim 1, wherein said coupling means includes:

said diving habitat body having an exhaust line extending from the interior of said habitat;

a chamber housing attached to said diving habitat body and having first and second collection chambers;

said first collection chamber being attached to said exhaust line for initially receiving expired breathing gas; and said second collection chamber being in fluid communication with said first collection chamber, the water environment and with said recovery line, said first and second collection chambers cooperating to provide means normally maintaining an expired breathing gas/water interface that allows for the transfer of expired breathing gas from said first chamber to said second chamber and to said recovery line and further cooperating to provide means for the transfer of water directly to said recovery line whenever the pressure in said recovery line drops to an undesirable level.

6. The structure set forth in claim 5, including:

said chamber housing including a transfer passage connecting said first collection chamber with said second collection chamber.

7. The structure set forth in claim 6, including said first collection chamber being in fluid communication with said water environment.

8. The structure set forth in claim 7, including:

said housing for said first and second collection chambers being tubular in configuration and having openings therein providing fluid communication between said chambers and said water environment.

9. The structure set forth in claim 1, wherein said coupling means includes:

a tubular ring mounted with said habitat and connected to said exhaust line and to said recovery line, said tubular ring having an opening to said water environment.

10. The structure set forth in claim 9, including:

tilt control means for maintaining the hydrostatic pressure of said water environment on said opening in spite of said tubular ring being tilted with said habitat body from an upright position.

11. The structure set forth in claim 9, wherein said tilt control means includes:

a housing attached to said tubular ring at said opening to said water environment and having a first chamber therein which is in fluid communication with said opening;

said housing having a second chamber in fluid communication with said first chamber and with said water environment; and said housing being positioned with respect to said tubular ring opening that a portion of said second chamber is always exposed to water at a hydrostatic pressure level sufficient to prevent the escape of expired breathing gas to such water environment.

12. The structure set forth in claim 11, including:

said housing being in a generally elongated configuration and said second chamber of said housing being in a generally elongated configuration and being open to said first chamber at one end thereof and being open to said water environment at the other end thereof.

13. The structure set forth in claim 12, including:

a third generally elongated chamber positioned adjacent to said second chamber, said third chamber having an opening to said first chamber on said other housing end and having an opening to said water environment at said one housing end.

14. The structure set forth in claim 9, including:

an auxiliary chamber means attached to said opening in said tubular ring, said auxiliary chamber means having at least a portion thereof subject to a greater pressure than the recovery line in spite of tilting of said habitat body in order to prevent the loss of expired breathing gas outwardly of said tubular ring opening with said tubular ring being in a tilted position.

15. The structure set forth in claim 9, including:

valve means mounted in said recovery line to control the pressure therein.

16. The structure set forth in claim 9, including:

a tube-like member attached to said tubular ring, said tube-like member being curved to extend outside of the rim of said tubular ring on both sides of said tubular ring opening.

17. The structure set forth in claim 9, including:

a tube-like member attached to said tubular ring and including a portion positioned below said connection of recovery line to said tubular ring when the habitat body is tilted either clockwise or counterclockwise whereby under normal pressure conditions, said expired breathing gas will flow from said habitat exhaust line to said recovery line.

18. The structure set forth in claim 9, including:

said tubular ring opening being attached to a hose member which includes a first portion extending outside of one side of said tubular ring and a second portion extending outwardly of the opposite side of said tubular ring so that either said first or second portion is positioned below said tubular ring with said tubular ring rotating to a clockwise or counterclockwise position.

* * * * *